US005881712A

United States Patent [19]

Moroi et al.

[11] Patent Number: 5,881,712

[45] Date of Patent: Mar. 16, 1999

[54] VEHICLE HEATERS

[75] Inventors: Takahiro Moroi; Takashi Ban; Tatsuyuki Hoshino; Hidefumi Mori; Hajime Ito; Shinji Aoki, all of Kariya; Toshio Morikawa, Toyota, all of Japan

[73] Assignee: Kabushiki Kaisha Toyoda Jidoshokki Seisakusho, Kariya, Japan

[21] Appl. No.: 89,803

[22] Filed: Jun. 3, 1998

[30] Foreign Application Priority Data

Jun. 4, 1997 [JP] Japan ..... 9-146778

[51] Int. Cl.[6] ..... F24C 9/00

[52] U.S. Cl. ..... 126/247; 237/12.3 R; 237/12.3 B

[58] Field of Search ..... 237/12.3 R, 12.3 B; 122/26; 126/247; 123/142.5 R

[56] References Cited

U.S. PATENT DOCUMENTS 5,573,184 11/1996 Martin ..... 237/12.3 R

*Primary Examiner*—Henry A. Bennett
*Assistant Examiner*—Derek Boles
*Attorney, Agent, or Firm*—Morgan & Finnegan, LLP

[57] ABSTRACT

A viscous fluid type heater is disclosed. The heater has a front housing and a rear housing secured to each other. The front housing has a space in which a first partitioning plate and a second partitioning plate located immovably fitted. A heating chamber that is defined between the first plate and the second plate accommodates viscous fluid. A rotor is rotatably supported in the heating chamber. The rotor rotates and shears the viscous fluid to generate heat. A heat exchange chamber is defined by the first and the second partitioning plates and disposed adjacent to the heating chamber. The heat exchanging chamber allows circulating fluid to flow therethrough so that the circulating fluid is heated by the heat transmitted to the heat exchanging chamber from the heating chamber. A securing structure secures the partitioning plates to the housing and concaves are formed in the outer peripheral surface of the partitioning plates to decrease a contacting area of the outer peripheral surface and the inner peripheral surface.

24 Claims, 5 Drawing Sheets

VEHICLE HEATERS

BACKGROUND OF THE INVENTION

1. Field of the Invention

The present invention relates to a vehicle heater, in particular, a vehicle heater having a heating chamber and a heat exchange chamber, the heating chamber having a rotor connected to a drive shaft to shear viscous fluid and produce heat to heat up circulating fluid flowing in the heat exchange chamber.

2. Description of the Related Art

U.S. Pat. No. 5,573,184 discloses a heater incorporated into a heating device for motor vehicles. The heater, as shown in FIG. 5, is provided with a fixed housing 52, a working chamber 53 therein and a cooling chamber 56 arranged adjacent to the working chamber 53. The fixed housing 52 has a housing cover or lid 52*a*, a housing floor 52*b* and an intermediate wall 57. The working chamber 53 and the cooling chamber 56 are defined separately with the intermediate wall 57. The intermediate wall 57 is provided with cooling ribs 57*a* protruding into the cooling chamber 56. A drive shaft 58 is rotatably supported by a ball bearing 63 on the fixed housing 52. A rotor 54 is fixed to an end of the drive shaft 58 so that the rotor 54 can rotate in the working chamber 53 as an integrated part of the shaft. The working chamber 53 is filled with viscous fluid (e.g., silicone oil) so as to completely cover the gap between outer walls of the rotor 54 and inner walls of the working chamber 53.

An inlet connector 68 and an outlet connector 69 are formed on the housing floor 52*b*. A coolant (circulating water) flows through heater form the inlet connector 68 to the outlet connector 69.

An engine transmits the drive force to the drive shaft 58 of the heater via an electromagnetic clutch. The rotor 54 integrally rotates with the drive shaft 58 in the working chamber 53. The viscous fluid between the outer wall of the rotor 54 and the inner wall of the working chamber 53 is then stirred to be shared, generating heat as a result of fluid friction. The heat generated in the working chamber is transmitted via the intermediate wall 57 to the coolant flowing through the cooling chamber 56. This coolant is fed to a heat radiator.

The conventional heater has the cooling chamber 56 that is defined by the intermediate wall 57 at the sides of the front wall, the circumferential wall, and the rear wall of the working chamber 53. However, the intermediate wall 57 is not axially and radially aligned with respect to the rotor 54. This makes it difficult, particularly when the rotor 54 is driven at high speed, to keep a slight clearance defined between the outer surfaces of the rotor 54 and the inner wall surfaces of the working chamber 53 constant.

The cooling chamber 56 has a front cooling chamber 56*a* and a rear cooling chamber 56*b* which are connected to each other by way of the gap adjacent to the circumferential walls of the working chamber 53. The coolant in the rear cooling chamber 56*b* flows into and from the front cooling chamber 56*a* via the gap. However, since the gap has a very small width in the radial direction with respect to the rotor 54, the coolant entered the rear cooling chamber 56*a* through the inlet connector 68, is not able to easily flow into the front cooling chamber 56*b*.

In addition, the coolant reached the rear cooling chamber 56*b* tends to remain therein and hardly flows back to the front cooling chamber 56*a*. Accordingly, the circulating passage is not sufficient for the coolant to flow from the inlet connector 68 into the outlet connector 69 while flowing through the respective cooling areas equally.

Further, the gap connecting the front cooling chamber 56*a* with the rear cooling chamber 56*b* might not be able to maintain its predetermined width because the intermediate wall 57 is not radially positioned with a sufficient accuracy. Therefore, efficient heat exchange between the working chamber 53 and the cooling chamber 56 cannot be expected.

SUMMARY OF THE INVENTION

It is an objective of the present invention to provide a vehicle heater operable with an improved heat efficiency of the circulating fluid.

It is another objective of the present invention to provide a vehicle heater which can prevent a heat loss occurred by emitting a heat generated in the heating chamber via a housing into the air.

To achieve the above objectives, an improved viscous fluid type heater is disclosed. The viscous fluid type heater has a housing including an inner peripheral surface, a heating chamber which is defined in the housing and accommodates viscous fluid, a rotor rotatably supported in the heating chamber, wherein said rotor rotates and shears the viscous fluid to generate heat, a heat exchange chamber defined adjacent to the heating chamber within a housing, wherein said heat exchanging chamber allows circulating fluid to flow therethrough so that the circulating fluid is heated by the heat transmitted to the heat exchanging chamber from the heating chamber. The heater further includes partitioning means for partitioning the heating chamber and the heat exchange chamber within the housing, the partitioning means having an outer peripheral surface contacting the inner peripheral surface of the housing, a securing structure that secures said partitioning means to the housing and a concave formed with the outer peripheral surface of the partitioning means to decrease a contacting area of the outer peripheral surface with inner peripheral surface of the housing.

Other aspects and advantages of the invention will become apparent from the following description, taken in conjunction with the accompanying drawings, illustrating by way of example the principals of the invention.

BRIEF DESCRIPTION OF THE DRAWINGS

The invention, together with objects and advantages thereof, may best be understood by reference to the following description of the presently preferred embodiments together with the accompanying drawings, in which.

DETAILED DESCRIPTION OF THE PREFERRED EMBODIMENTS

A first embodiment of a heater used for a vehicle's heating device will be described hereinafter with reference to FIGS. 1 and 2.

Figure 1:
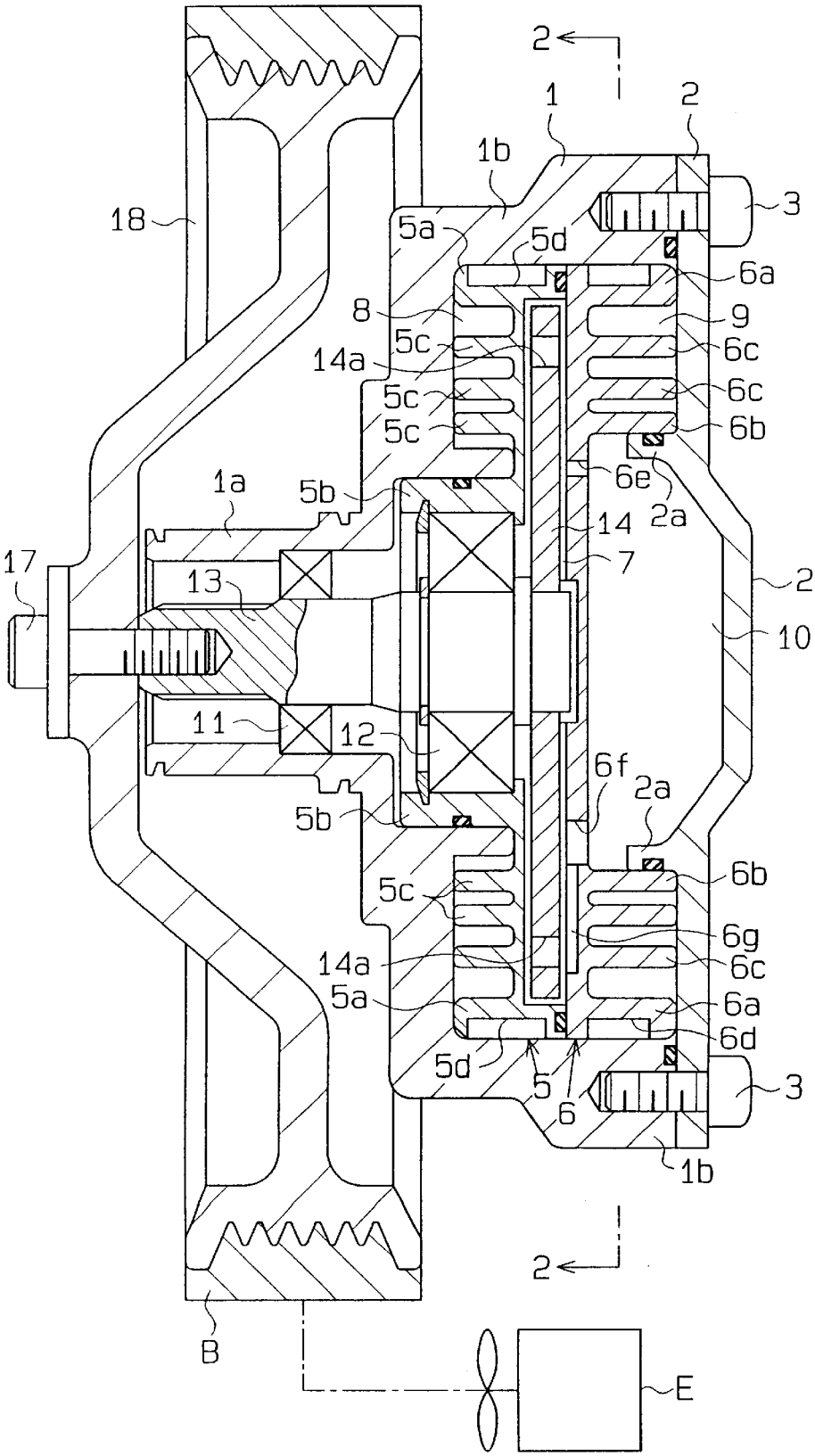
FIG. 1 is a longitudinal cross-sectional view of a vehicle heater according to the first embodiment of the present invention.

As shown FIG. 1, the heater has an outer shell consisting of a front housing 1 and a rear housing 2. The front housing 1 includes a cylindrical, hollow boss 1*a* and a cylindrical case 1*b*. The boss 1*a* extends frontward (toward the left as viewed in the drawing) while the case 1*b* rearward flared. The rear housing 2 is formed in the shape of a lid covering an opening of the case 1*b*. The front and rear housings 1, 2 accommodate therebetween a front disk plate 5 and a rear disk plate 6. The front and rear housings 1, 2 are fastened to each other by a plurality of bolts 3. The front housing 1, the rear housing 2 and the section plates 5, 6 are made of aluminum or aluminum alloy.

The front plate 5 has an annular rim 5*a* on its periphery. The end (the left side shown in FIG. 1) of the rim 5*a* contacts the inner surface of the case 1*b*. The rear wall of the front plate 5 has annular recesses formed thereon. In other words, the rim 5*a* has rear end protruding rearward. A channel 5*d* extends on the outer peripheral surface of the rim 5*a* along the entire circumferential direction. The front plate 5 has a cylindrical support hub 5*b* and a plurality of guide fins 5*c*. The hub 5*b* projects forward from the central portion of the front plate 5. The guide fins 5*c* extend concentrically in the circumferential direction along the periphery of the support hub 5*b*.

The rear plate 6 has an annular rim 6*a* extending along the periphery of the rear plate 6. The rim 6*a* has an end portion (the right side in FIG. 1) kept in contact with the inner surface of the rear housing 2. A channel 6*d* extends on the outer peripheral surface of the rim 6*a* along the entire circumferential direction. The rear plate 6 has an annual protrusion 6*b* and a plurality of guide fins 6*c*. The protrusion 6*b* projects from the central portion of the rear plate 6. The guide fins 6*c* extend concentrically in the circumferential direction along the periphery of the annual protrusion 6*b*.

Both the plates 5 and 6 are held between walls of housings 1, 2 which are opposed and connected to each other. In this state, the rear end of the rim 5*a* and the front surface of the rear plate 6 are coupled to each other. Accordingly, the plates 5, 6 are positioned so as to be immovable in the axial direction. Further, the peripheral surfaces of the rims 5*a*, 6*a* of the plates 5, 6 contact the inner surface of the cylindrical case 1*b*. Accordingly, both the plates 5, 6 are positioned so as to be immovable in the radial direction with respect to the front housing 1. Therefore, both the plates 5, 6 are accommodated immovably in the housings 1, 2 in both of the axial and the radial directions. Further, the heating chamber 7 is provided in the area surrounded by a recess formed between the front plate 5 and the rear plate 6.

In the state that the front plate 5 is fitted in the front housing 1, a portion of the support hub 5*b* is in watertight contact with the inner wall of the front housing 1. As a result, an annular front water jacket 8 is defined between the inner wall of the front housing 1 and the body of the front plate 5. The water jacket 9 is positioned in front of the heating chamber 7. The water jacket 8 serves as a heat exchange chamber. In the water jacket 8, the rim 5*a*, the support hub 5*b* and the guide fins 5*c*, and the wall surface of the channel 5*d* serve as guide walls guiding the flow of coolant as a circulating fluid. The rim 5*a*, the support hub 5*b* and the guide fins 5*c*, and the wall surface of the channel 5*d* constitute a flow passages for the coolant. The flow passages have different cross sections. The guide fins 5*c* are spaced by different distances from one another so that the passage remote from the hub 5*b* has capacity greater than that of the passage close to the hub 5*b*.

In the state that the rear plate 6 is fitted in the front housing 1 together with the front plate 5, the protrusion 6*b* is in watertight contact with an annular wall 2*a* of the rear housing 2. As a result, an annular rear water jacket 9 and a sub-oil chamber 10 are respectively defined between the rear housing 2 and the rear plate 6.

The rear water jacket 9, serving as the heat exchange chamber, is disposed adjacent to the rear side of the heating chamber 7. The sub-oil chamber, serving as a reservoir, is located in the protrusion 6*b*. In the rear water jacket 9, the rim 6*a*, the protrusion 6*b* and the guide fins 6*c*, and the wall surface of the circumferential channel 6*d* serve as guide walls guiding the flow of the coolant. The rim 6*a*, the protrusion 6*b* and the guide fins 6*c*, and the wall surface of the circumferential channel 6*d* constitute a flow passage for the coolant within the water jacket 9. The flow passages have different cross sections. The guide fins 6*c* are spaced by different distances from one another so that the passage remote from the hub 6*b* has capacity greater than that of the passage close to the hub 6*b*.

Figure 2:
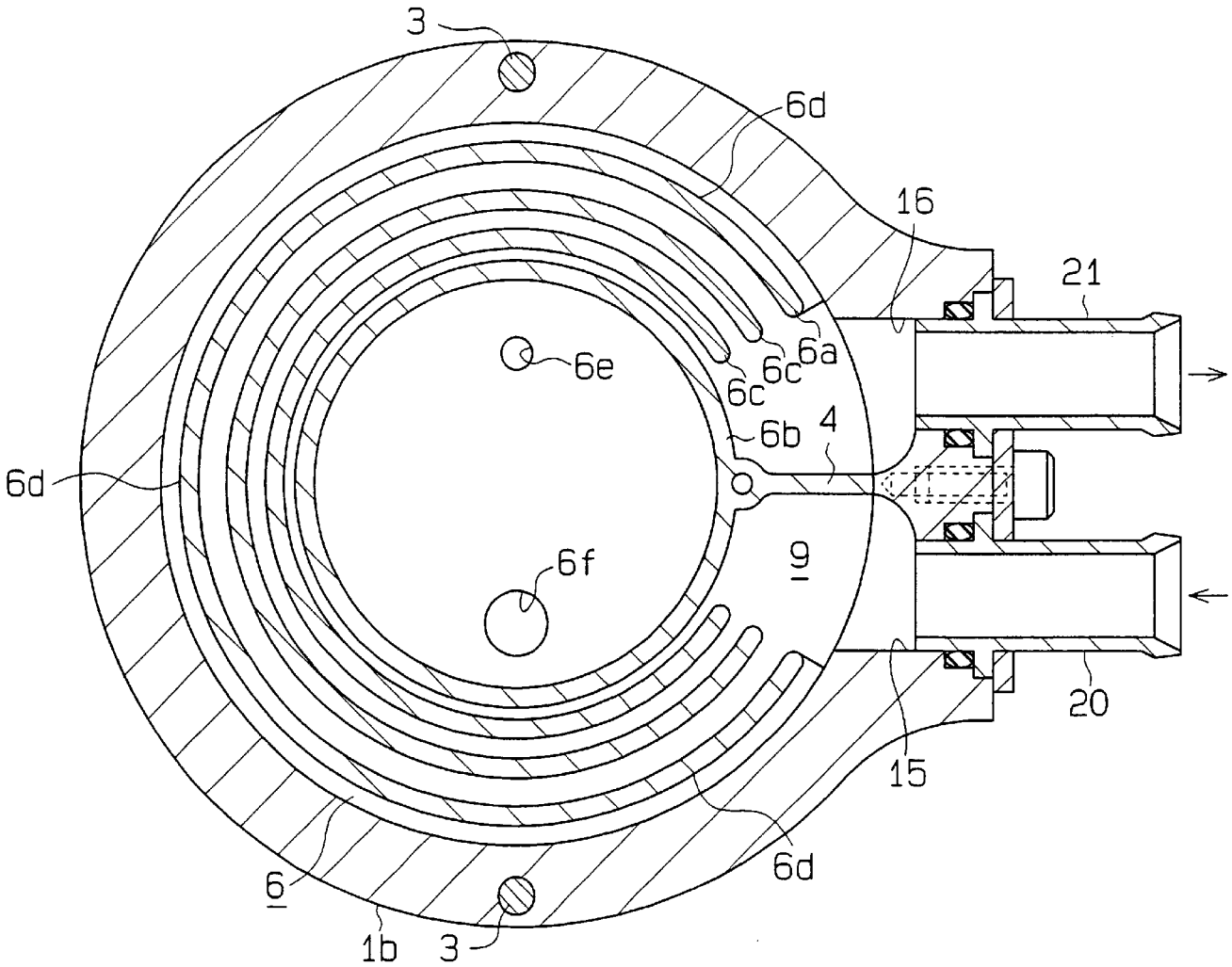
FIG. 2 is a sectional view along a line 2—2 of FIG. 1.

As shown in FIG. 2, a first port 15 and a second port 16 are vertically arranged on the side wall of the front housing 1. Further, each of the section plates 5, 6 has a horizontal wall 4 extending in its radial direction (only the rear plate 6 is shown in FIG. 2). The wall 4 extends to transverses the respective annual passages defined by the water jackets 8, 9, respectively. The wall 4 distinctly defines an inlet side and an outlet side of the passage, while connecting the inlet side of each passage with the first port 15 and the outlet side or each passage with the second port 16. Pipes 20 and 21 are respectively attached to the first port 15 and the second port 16 for connection to a heating circuit piping provided in the vehicle.

As shown in FIG. 1, a drive shaft 13 extending through the front housing 1 and the front plate 5 is rotatably supported by bearings 11, 12. The bearing 12 is provided with a seal and is arranged between the inner surface of the support hub 5*b* and the outer surface of the drive shaft 13. Thus, the bearing 12 seals the front side of the heating chamber 7. A disk-like rotor 14 is fitted to the rear end of the drive shaft 13 in the heating chamber 7. The rotor 14 rotates integrally with the drive shaft 13. A plurality of through bores 14*a* extend through the rotor 14 near the periphery of the rotor 14. These bores 14*a* are equidistantly disposed from an axis of the drive shaft 13 and equianglerly spaced from each other.

The sub-oil chamber 10, serving as the reservoir chamber, is defined in the region surrounded by the hub 6*b* and the front end wall of the rear housing 2. An upper communication bore 6*e* and a lower communication bore 6*f* extend axially through the rear plate 6. A guide groove 6*g* extends radially on the front surface of the rear plate 6. The heating chamber 7 and the sub-oil chamber 10 are connected with each other through the upper and lower bores 6*e*, 6*f*. The lower bore 6*f* has a cross section greater than that of the upper bore 6*e*.

The heating chamber 7 and the sub-oil chamber 10, which are connected with each other via the upper and the lower communication bores 6*e* and 6*f*, define a watertight space in the heater housing. A predetermined amount of silicone oil, as viscous fluid, is accommodated in the space. The amount of the silicone oil is determined so that the filling rate at a normal temperature is in the range of 50% to 80% by volume of the space. Nevertheless the space is filled by the filling rate, the silicone oil is, owing to its high viscosity, drawn from the sub-oil chamber 10 via the lower bore 6*f* and the guide groove 6*g* during rotation of the rotor 14. The drawn silicone oil can be delivered evenly to the entire slight clearance between the inner wall surface of the heating chamber 7 and the outer surface of the rotor 14. When the silicone oil is charged, the upper bore 6*e* is located above the surface level of the silicone oil reserved in the sub-oil chamber 10, while the lower bore 6*f* being below the surface level.

A pulley 18 is secured to the front end of the drive shaft 13 by a bolt 17. The pulley 18 is connected to a vehicle engine E, serving as an exterior drive source, by a v-belt B.

The operation of the heater will now be described. Before driving the engine E, i.e., when the drive shaft 13 is in a non-operating state, the silicone oil (viscous fluid) in the heating chamber 7 and the sub-oil chamber 10 have the fluid surface level equal to each other. Accordingly, when the drive shaft 13 starts to run, the rotor surface contacts the viscous fluid with its small portion. Therefore, the pulley 18, the drive shaft 13 and the rotor 14 can be driven with a small torque. As the drive shaft 13 and the rotor 14 is rotated integrally, the silicone oil is sheared in the clearance to generate the heat.

The heat generated in the heating chamber 7 is transmitted via each of the plates 5, 6 to the circulating coolant flowing through the water jackets 6 and 9. Specifically, as shown in FIG. 2, the circulating water entering each of the water jackets 8, 9 (in FIG. 2, only the rear water jacket 9 is shown), via the first port 15 subsequently flows into each passage. The coolant simultaneously flows into the circumferential channels 5*d*, 6*d* since the wall of channels 5*d*, 6*d* serve as a guide wall for guiding the circulating water. The coolant flows throughout the passage while moving along the guide wall, and reaches the second port 16. Thus, the heat generated in the heating chamber 7 is thoroughly used for heat transmission, since the circulating water flows into the passage including the outermost circumferential channels 5*d*, 6*d*. The heated circulating water is then provided for heating the drivers compartment.

The sub-oil chamber 10 communicates the central area of the heating chamber 7 via the upper bore 6*e*, while the silicone oil in the heating chamber 7 tending to move toward the drive shaft 13 owing to the rotation of the rotor 14 (Weissenberg effect). Therefore, silicone oil moves from the heating chamber 7 into the sub-oil chamber 10 through the upper bore 6*e*. On the other hand, the weight of the silicone oil collected in the sub-oil chamber 10, and a drawing action of the rotor 14 owing to the high viscosity of the silicone oil cause the silicone oil to be supplied to the heating chamber 7.

As mentioned above, the silicone oil is circulated between the heating chamber 7 and the sub-oil chamber 10 when the drive shaft 13 and the rotor 14 are driven. Since the lower bore 6*f* has an opening larger than that of the upper bore 6*e*, the heating chamber receives the larger amount of the silicone oil than the sub-oil chamber 10 collects. Accordingly, the silicone oil reserved in the sub-oil chamber 10 is rapidly and smoothly delivered to an outer periphery area of the heating chamber 7 through the guide groove 6*g*. The silicone oil delivered to the outer peripheral area of the heating chamber then reaches the central portion due to the Weissenberg effect. Therefore, the silicone oil is charged throughout the clearance defined between the outer surface of the rotor 14 and the inner wall surface of the heating chamber 7.

The silicone oil collected from the heating chamber 7 to the sub-oil chamber 10 through the upper bore 6*e* remains in the sub-oil chamber 10 for a time period corresponding to a cycle for the circulation of the silicone oil. The silicone oil is in a high temperature just after collecting from the heating chamber 7. However, the heat is removed from the silicone oil because the heat is partially transmitted to the components defining the sub-oil chamber 10, namely the rear plate 6, while the silicone oil remains in the sub-oil chamber 10. Consequently, the silicone oil in the high temperature is cooled and prevented from its deterioration, which is generally caused by being heated for a excessively long period.

The heater has the channels 5*d*, 6*d* respectively extending along the entire peripheries of the rims 5*a*, 6*a*. The contact area between the outer walls of the plates 5, 6 and the inner walls of the housings 1 and 2 is small in comparison with the plates without the channels 5*d* and 6*d*. Thus, heat transmission through the plates 5, 6 to the housings is restrained. Consequently, the heat loss caused by emitting large amount of the heat from the heating chamber 7 into the air can be prevented The inner wall surfaces of the channels 5*d*, 6*d* function as guide surfaces for guiding the circulating water which flows throughout the water jackets 8, 9. Accordingly, the circulating water moves and spreads through the channels 5*d*, 6*d*, as well as other passages. Therefore, the heat generated in the heating chamber 7 can be thoroughly transmitted to the circulating water with the high heat-exchange-efficiency. At the same time, the heat generated in the silicone oil subjected to the shearing action in the heating chamber 7 is able to be efficiently removed. Accordingly, this prevents the silicone oil from being heated up in excess of a critical temperature, and, thus, results in less deterioration of the silicone oil.

The section plates 5, 6 respectively have the outer peripheral walls kept in watertight contact with the inner circumferential walls of the housing. However, the circumferential grooves 5*d*, 6*d* minimize the contact area of the plates 5, 6 with the housing bodies 1, 2, while the plates 5, 6 are immovably fitted in the housings. The section plates 5, 6 not only securely define the heating chamber 7 and water jackets 8, 9, but can maintain the slight clearance between the inner surface of the chamber 7 and the outer surface of the rotor 14 even when the rotor 14 rotates at the high speed. In addition, since the flow passage formed in the water jackets 8, 9 allows the effective heat transmission from the heating chamber 7 to the circulating water and the smooth flow of the circulating coolant.

Second Embodiment

Figure 3:
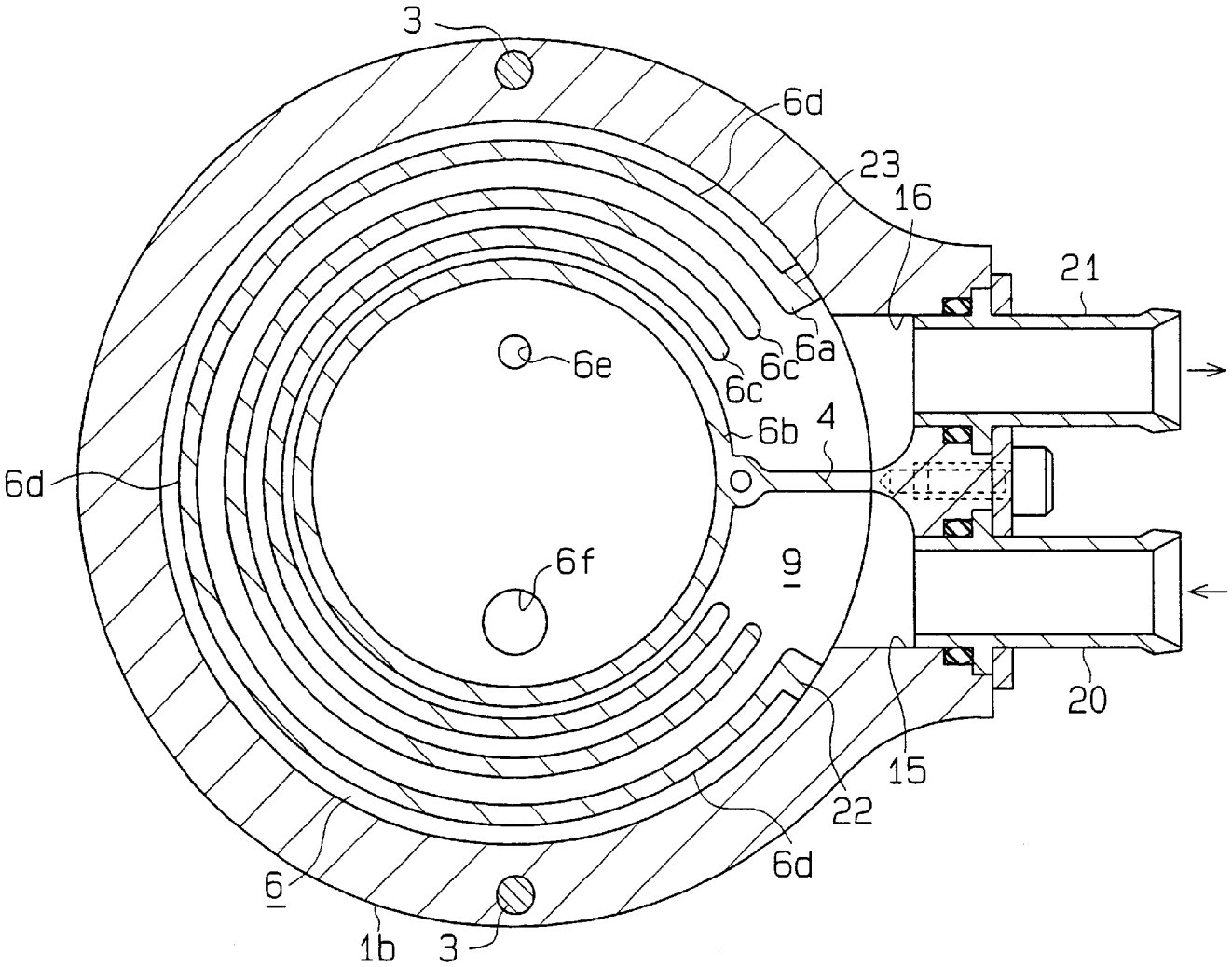
FIG. 3 is a cross-sectional view of the heater according to the second embodiment of the present invention.

FIG. 3 shows a heat generator according to a second embodiment of the invention. This heat generator is a slight modification of the device described in the first embodiment, emphasizing recesses formed on the plates 5, 6.

As shown in FIG. 3, the plates 5, 6 respectively have the grooves 5*d*, 6*d* which extend in the circumferential direction on the rim 5*a*, 6*a*. It is noted that FIG. 3 merely shows the rear plate 6 and passages formed in the plate. However, the following explanation may be applied to the detailed construction of the plate 5.

As shown in FIG. 3, the groove 6*d* does not extend along the entire circumference of the plate 5, 6. In other words, first sealing portion 22 is provided at first end of the rim 6*a* and. Likewise, a second sealing portion 23 is formed at a second end of the rim 6*a*. Thus, the groove 6*d* forms independent air space extending concentrically with the rim 6*a* between the inner wall of the case 1*b* and the peripheral surface of the plates 6.

The air in the groove 6*d* is substantially in a stationary state dislike the circulating water flowing in the groove. The air has a small heat transfer rate in comparison with the water. Accordingly, the heat transmission between the housing 2 and the plate 6 can be restrained more successively. Therefore, according to the embodiment shown in FIG. 3, heat insulating efficiency in the radial direction with respect to the housing 2 can be far improved to prevent a heat emission into the air causing a heat loss.

Figure 4:
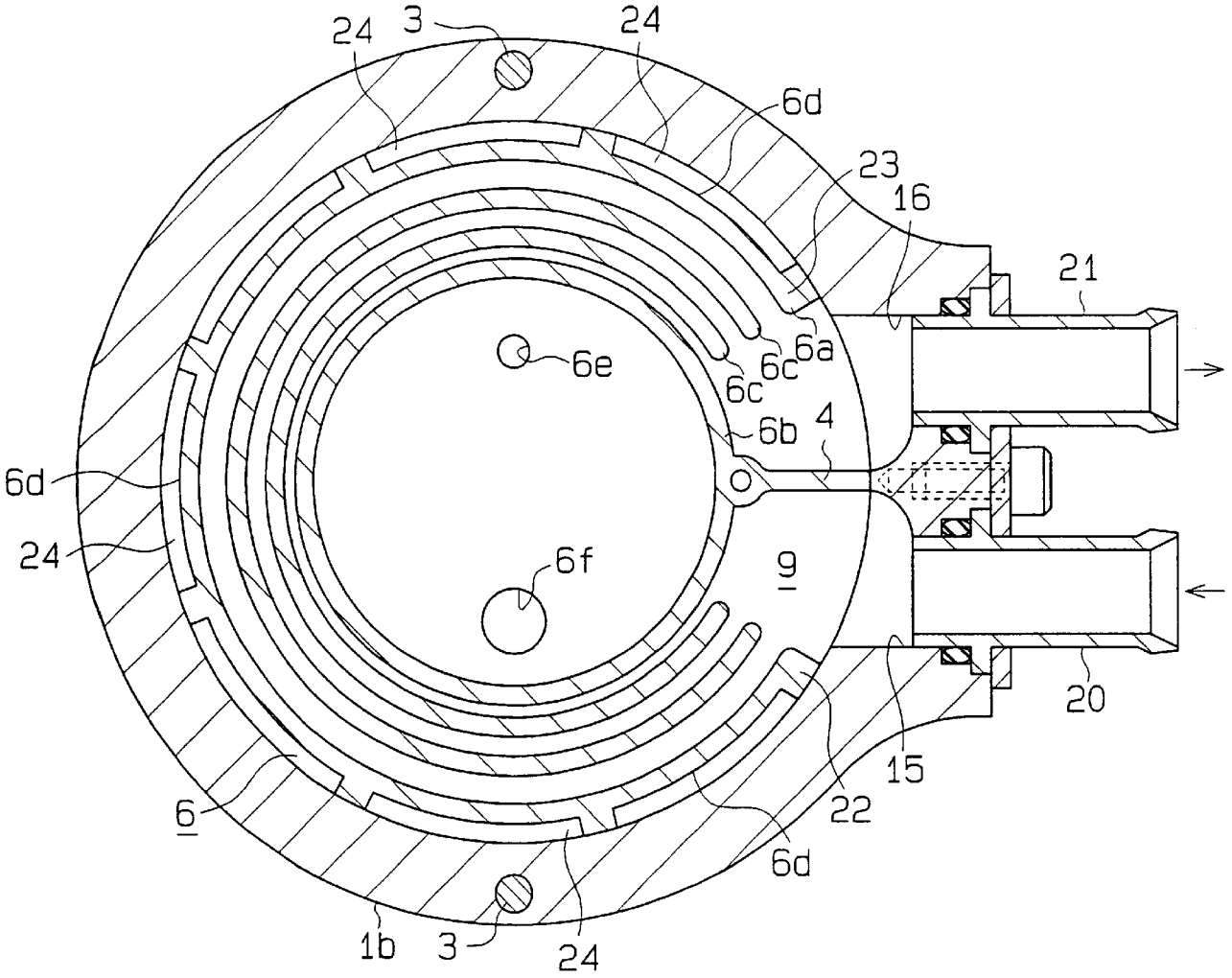
FIG. 4 is a cross-sectional view showing a modification of the second embodiment.
Figure 5:
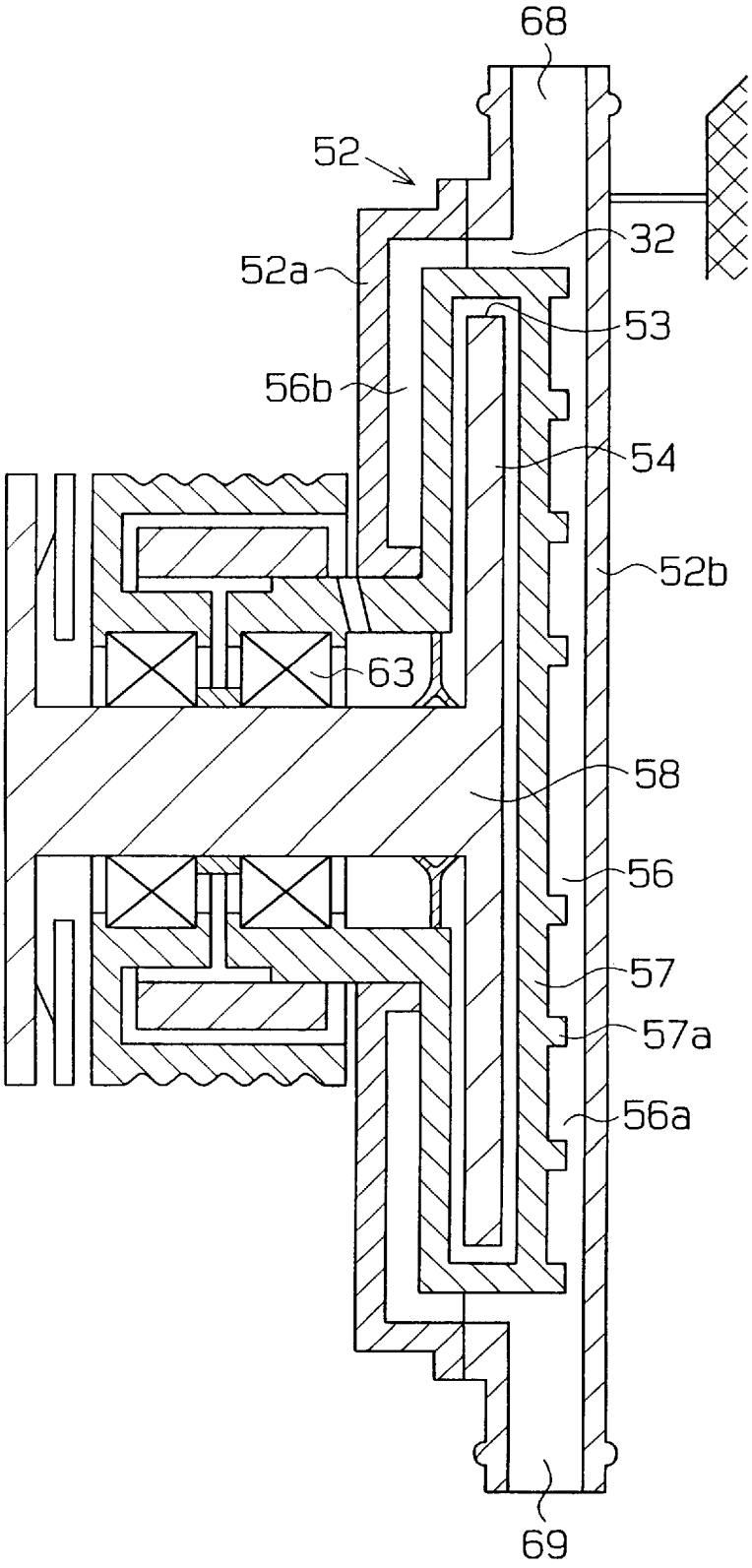
Fig.5(Prior Art)
FIG. 5 is a cross-sectional view showing a conventional heater.

FIG. 4 illustrates a modification of the second embodiment. In the modification, the groove 6*d* may be divided into a plurality of sections 24. This makes positioning of the both plates 5, 6 more accurate.

It in noted that the term "viscous fluid" used herein is not limited to liquids or semi-viscosity fluids having a high viscosity such as silicone oil and may be any kind of medium that generates heat when the shearing effect of the rotor 14 produces fluid friction.

What is claimed is:

1. A viscous fluid type heater comprising:

a housing, said housing including an inner peripheral surface;

a heating chamber defined in the housing, said heating chamber accommodating viscous fluid;

a rotor rotatably supported in the heating chamber, wherein said rotor rotates and shears the viscous fluid to generate heat;

a heat exchange chamber defined adjacent to the heating chamber within a housing, wherein said heat exchanging chamber allows circulating fluid to flow therethrough so that the circulating fluid is heated by the heat transmitted to the heat exchanging chamber from the heating chamber;

partitioning means for partitioning the heating chamber and the heat exchange chamber within the housing, said partitioning means having an outer peripheral surface contacting the inner peripheral surface of the housing;

a securing structure that secures said partitioning means to the housing; and a concave formed with the outer peripheral surface of the partitioning means to decrease a contacting area of the outer peripheral surface with the inner peripheral surface of the housing.

2. The heater as set forth in claim 1, wherein said partitioning means includes a first partitioning plate and a second partitioning plate secured to each other.

3. The heater as set forth in claim 2, wherein said first partitioning plate and said second partitioning plate respectively have inner side surfaces that define said heating chamber therebetween, and wherein said first partitioning plate and said second partitioning plate respectively have outer side surfaces that define the associated heat exchanging chamber in the housing.

4. The heater as set forth in claim 3, wherein said concave includes a first circumferential groove formed in the first partitioning plate and a second circumferential groove formed in the second partitioning plate.

5. The heater as set forth in claim 4, wherein said first partitioning plate and said second partitioning plate respectively have rims serving as said securing means and having said outer peripheral surfaces contacting the inner peripheral surface of the housing, whereby the partitioning plates are immovably positioned in radial direction with respect to the rotor.

6. The heater as set forth in claim 5, wherein said first partitioning plate and said second partitioning plate respectively have fins projecting from the outer side surfaces and wherein a first fluid passage and a second fluid passage respectively extend between the fins in the outer side surfaces of the first partitioning plate and the second partitioning plate.

7. The heater a set forth in claim 4, wherein each of said circumferential groove has a first end and a second end that are open to allow the circulating fluid to flow therethrough.

8. The heater as set forth in claim 4, wherein each of circumferential grooves has a first end and a second end that are closed to accommodate air therein.

9. The heater as set forth in claim 8, wherein said circumferential groove is divided into a plurality of sections.

10. The heater as set forth in claim 6, further comprising a drive shaft for supporting the rotor for an integral rotation, wherein said housing has inner side surface opposed to each other, wherein said securing structure includes the rims that are formed in the partitioning plates are in contact with the associated inner side surfaces of the housing, whereby the partitioning plates are immovably positioned in the axial direction with respect to the drive shaft.

11. A viscous fluid type heater comprising:

a first housing and a second housing secured to said first housing, said first housing having outer peripheral surfaces, said first housing having a space therein, said second housing closing the space;

a first partitioning plate immovably fitted within the space;

a second partitioning plate located adjacent to the first partitioning plate and immovably fitted within the space;

said first partitioning plate and said second partitioning plate respectively having outer peripheral surfaces contacting the associated inner peripherl surfaces of the first housing;

a heating chamber defined between the first partitioning plate and the second partitioning plate, said heating chamber accommodating viscous fluid;

a rotor rotatably supported in the heating chamber, wherein said rotor rotates and shears the viscous fluid to generate heat;

a heat exchange chamber defined by the fist partitioning plate and the second partitioning plate and disposed adjacent to the heating chamber within the space, wherein said heat exchanging chamber allows circulating fluid to flow therethrough so that the circulating fluid is heated by the heat transmitted to the heat exchanging chamber from the heating chamber; and concaves respectively formed in each of the outer peripheral surfaces of the partitioning plates to decrease a contacting area of the outer peripheral surface with the inner peripheral surface of the first housing.

12. The heater as set forth in claim 11, wherein said first partitioning plate and said second partitioning plate respectively have inner side surfaces that define said heating chamber therebetween, and wherein said first partitioning plate and said second partitioning plate respectively have outer side surfaces that define the associated heat exchanging chamber in the housing.

13. The heater as set forth in claim 12, wherein said concaves include a first circumferential groove formed in first partitioning plate and a second circumferential groove formed in the second partitioning plate.

14. The heater as set forth in claim 13, wherein said first housing has a first inner peripheral surface and said second housing has a second inner side surface opposed to the first inner side surface, wherein said first partitioning plate and said second partitioning plate respectively have rims having said outer peripheral surface contacting with the inner peripheral surface of the housing, the rims contacting the associated inner side surfaces of the first housing and said second housing, whereby the partitioning plates are immovably positioned in a radial direction with respect to the rotor.

15. The heater as set forth in claim 14, wherein said first partitioning plate and said second partitioning plate respectively have a first outer side surface and a second outer side surface, wherein said partitioning plates respectively have fins projecting from the outer side surfaces and wherein a first fluid passage and a second fluid passage respectively extend between the fines in the outer side surface of the first partitioning plate and the second partitioning plate.

16. The heater as set forth in claim 13, wherein each of the peripheral grooves has a first end and a second end that are open to allow the circulating fluid to flow therethrough.

17. The heater as set forth in claim 13, wherein each of the peripheral grooves has a first end and a second end that are closed to accommodate air therein.

18. The heater as set forth in claim 17, wherein said peripheral groove is divided into a plurality of sections.

19. The heater as set forth in claim 11, wherein said viscous fluid includes silicone oil.

20. A viscous fluid type heater comprising:

a first housing and a second housing secured to said first housing, said first housing having an inner peripheral surface, said first housing having a space therein, said second housing closing the space;

a first partitioning plate immovably fitted within the space, said first partitioning plate having an outer peripheral surface contacting the inner peripheral surface of the first housing;

a second partitioning plate located adjacent to the first partitioning plate and immovably fitted within the space, said second partitioning plate having an outer peripheral surface contacting the inner peripheral surface of the first housing;

a heating chamber defined between the first partitioning plate and the second partitioning plate, said heating chamber accommodating viscous fluid;

a rotor rotatably supported in the heating chamber, wherein said rotor rotates and shears the viscous fluid to generate heat;

a heat exchange chamber defined by the first partitioning plate and the second partitioning plate in the vicinity of the heating chamber within the space, wherein said heat exchanging chamber allows circulating fluid to flow therethrough so that the circulating fluid is heated by the heat transmitted to the heat exchanging chamber from the heating chamber;

a first peripheral groove extending in the outer peripheral surface of the first partitioning plate and a second peripheral groove extending in the outer peripheral surface of the second partitioning plate, whereby each of the grooves decreases a contacting area of each outer peripheral surface and the associated inner peripheral surface.

21. The heater as set forth in claim 20, wherein said first partitioning plate and said second partitioning plate respectively have a first outer side surface and a second outer side surface, wherein said partitioning plates respectively have fins projecting from the outer side surfaces and wherein a first fluid passage and a second fluid passage respectively extend between the fins.

22. The heater as set forth in claim 20, wherein each of the peripheral grooves has a first end and a second end that are open to allow the circulating fluid to flow therethrough.

23. The heater as set forth in claim 20, wherein each of the peripheral grooves has a first end and a second end that are closed to accommodate air therein.

24. The heater as set forth in claim 23, wherein said peripheral groove is divided into a plurality of sections.

* * * * *